US005660464A

United States Patent [19]

Lin

[11] Patent Number: 5,660,464

[45] Date of Patent: Aug. 26, 1997

[54] HALOGEN LAMP PROTECTION DEVICE

[76] Inventor: Shih-Ming Lin, No. 132, Hsi Hsin Street, Chuang Ya Tsun, Hsiu Shui Hsiang, Chang Hua Hsien, Taiwan

[21] Appl. No.: 723,364

[22] Filed: Sep. 30, 1996

[51] Int. Cl.[6] ..... F21V 15/02

[52] U.S. Cl. ..... 362/376; 362/374; 362/375

[58] Field of Search ..... 362/376, 378, 362/217, 223, 374, 375, 455, 457, 431, 414

[56] References Cited

U.S. PATENT DOCUMENTS

| | | | |
|---|---|---|---|
| 1,625,693 | 4/1927 | Vest | 362/455 |
| 2,469,412 | 5/1949 | Roebken | 362/376 |
| 5,243,507 | 9/1993 | Atkins et al. | 362/376 |

*Primary Examiner*—Thomas M. Sember

*Attorney, Agent, or Firm*—Beveride, DeGrandi, Weilacher & Young LLP

[57] ABSTRACT

A halogen lamp comprises a lamp casing, a lamp disposed in the lamp casing, a halogen tube disposed in the lamp, and a halogen lamp protection net covering the lamp. A protection plate covers the halogen tube. A first press plate has a first proximal end and a first distal end. A first through hole is formed on a middle portion of the first press plate. A first threaded hole is formed on the first distal end. A second press plate has a second proximal end and a second distal end. A second through hole is formed on a middle portion of the second press plate. A second threaded hole is formed on the second distal end. The first distal end is inserted in the lamp. The first proximal end presses a first end of the protection plate. The lamp and the first end of the protection plate are fastened together. The second distal end is inserted in the lamp. The second proximal end presses a second end of the protection plate. The lamp and the second end of the protection plate are fastened together. The halogen lamp protection net has a brim and a plurality of meshes. The halogen lamp protection net and the lamp are fastened together.

1 Claim, 2 Drawing Sheets

HALOGEN LAMP PROTECTION DEVICE

BACKGROUND OF THE INVENTION

The invention relates to a halogen lamp protection device. More particularly, the invention relates to a halogen lamp protection device to protect the user from burning.

A conventional halogen lamp is not protected by a halogen lamp protection device. The halogen lamp produces heat to elevate the temperatures around the halogen lamp. The user may be burned if the user touches the halogen lamp. In addition, the articles near the halogen lamp may cause fire easily.

SUMMARY OF THE INVENTION

An object of the invention is to provide a halogen lamp protection device to protect the user from burning.

Accordingly, a halogen lamp has a lamp casing, a lamp disposed in the lamp casing, a halogen tube disposed in the lamp, and a halogen lamp protection net covering the lamp. A protection plate covers the halogen tube. A first press plate has a first proximal end and a first distal end. A first through hole is formed on a middle portion of the first press plate. A first threaded hole is formed on the first distal end. A second press plate has a second proximal end and a second distal end. A second through hole is formed on a middle portion of the second press plate. A second threaded hole is formed on the second distal end. The first distal end is inserted in the lamp. The first proximal end presses a first end of the protection plate. The lamp and the first end of the protection plate are fastened together. The second distal end is inserted in the lamp. The second proximal end presses a second end of the protection plate. The lamp and the second end of the protection plate are fastened together. The halogen lamp protection net has a brim and a plurality of meshes. The halogen lamp protection net and the lamp are fastened together.

DETAILED DESCRIPTION OF THE INVENTION

Figure 1:
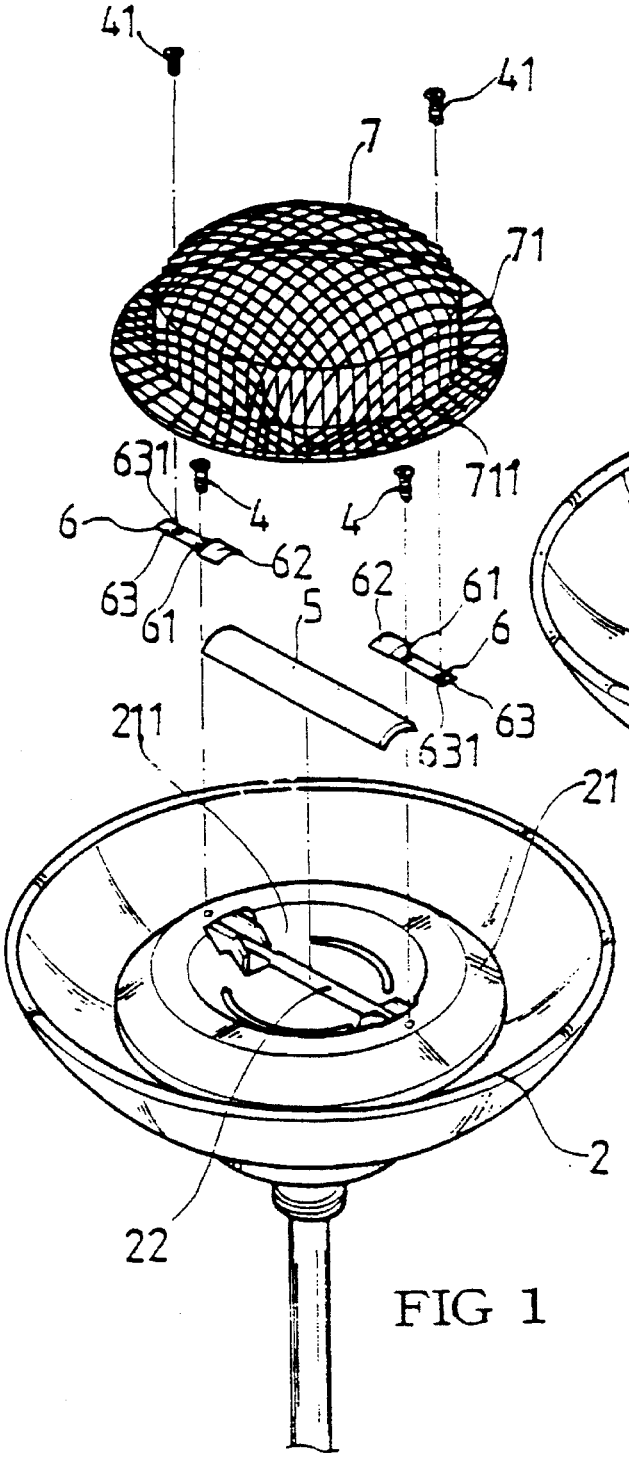
FIG. 1 is a perspective exploded view of a halogen lamp protection device of a preferred embodiment in accordance with the invention.
Figure 2:
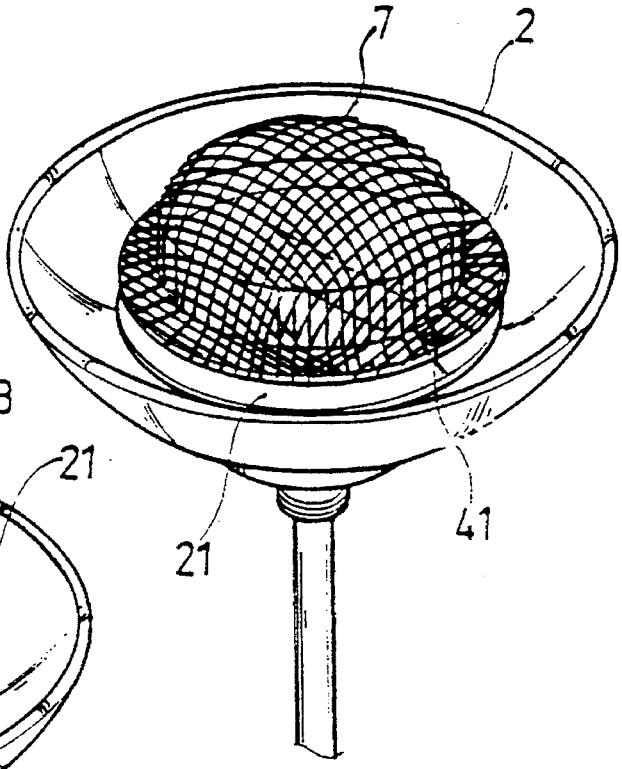
FIG. 2 is a perspective assembly view of a halogen lamp protection device of a preferred embodiment in accordance with the invention.
Figures 3, 4:
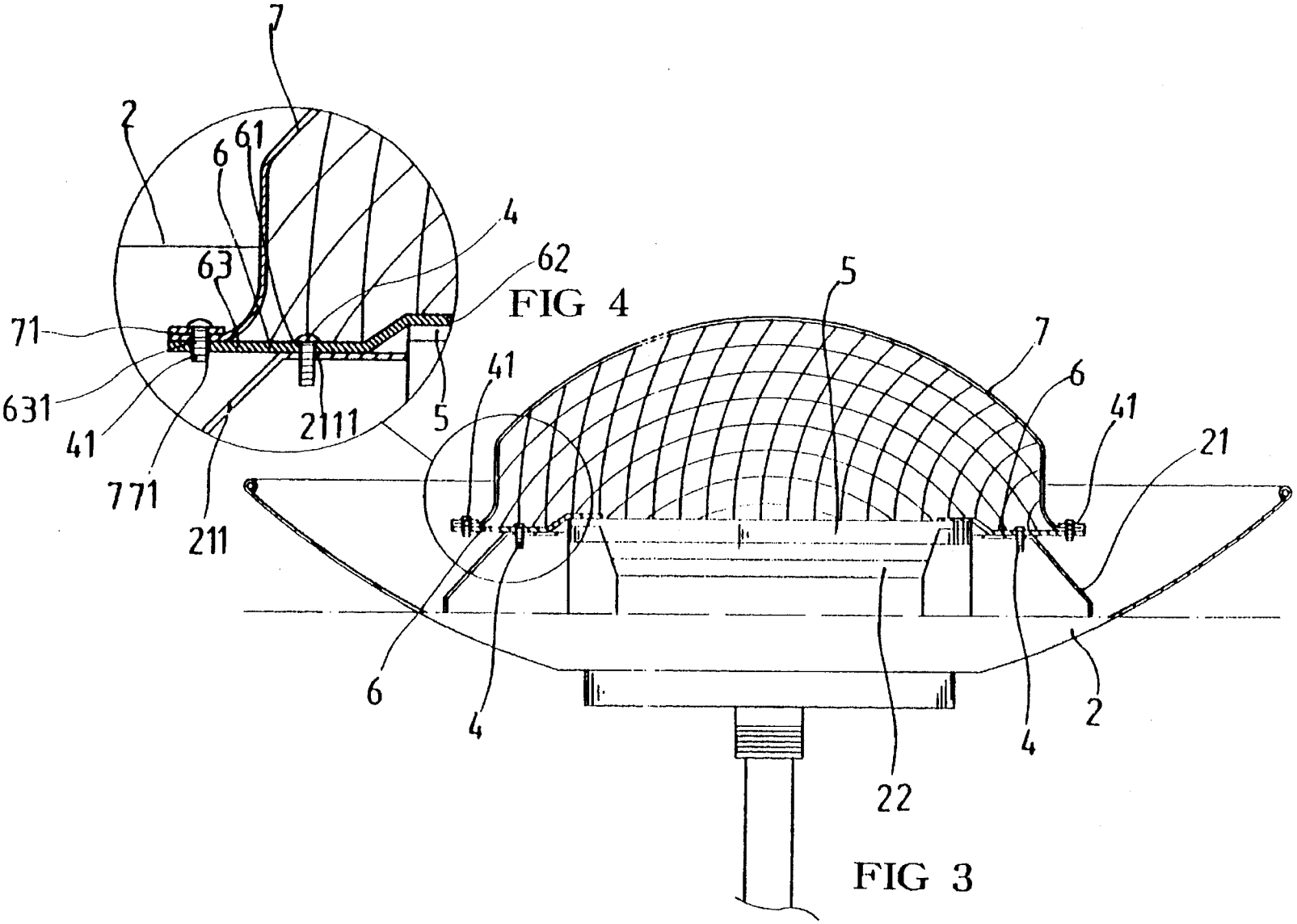
FIG. 3 is a schematic view illustrating a halogen lamp protection net protecting a halogen lamp.
FIG. 4 is a partially enlarged view of a portion of a halogen lamp protection net.

Referring to FIGS. 1 to 4, a halogen lamp comprises a lamp casing 2, a lamp 21 disposed in the lamp casing 2, a halogen tube 22 disposed in the lamp 21, and a halogen lamp protection net 7 covering the lamp 21. A protection plate 5 covers the halogen tube 22. A first press plate 6 has a first proximal end 62 and a first distal end 63. A first through hole 61 is formed on a middle portion of the first press plate 6. A first threaded hole 631 is formed on the first distal end 63. A second press plate 6 has a second proximal end 62 and a second distal end 63. A second through hole 61 is formed on a middle portion of the second press plate 6. A second threaded hole 631 is formed on the second distal end 63. The first distal end 63 is inserted in the lamp 21. The first proximate end 62 presses a first end of the protection plate 5. A first bolt 4 fastens the lamp 21 and the first end of the protection plate 5. The second distal end 63 is inserted in the lamp 21. The second proximal end 62 presses a second end of the protection plate 5. A second bolt 4 fastens the lamp 21 and the second end of the protection plate 5. The halogen lamp protection net 7 has a brim 71 and a plurality of meshes 711. A first and second screws 41 pass through the corresponding meshes 711 and the corresponding first and second threaded holes 631 to fasten the halogen lamp protection net 7 and the lamp 21 together.

The invention is not limited to the above embodiment but various modification thereof may be made. Further, various changes in form and detail may be made without departing from the scope of the invention.

I claim:

1. A halogen lamp comprising:

a lamp casing, a lamp disposed in said lamp casing, a halogen tube disposed in said lamp, a halogen lamp protection net covering said lamp, a protection plate covering said halogen tube, a first press plate having a first proximal end and a first distal end, a first through hole formed on a middle portion of said first press plate, a first threaded hole formed on said first distal end, a second press plate having a second proximal end and a second distal end, a second through hole formed on a middle portion of said second press plate, a second threaded hole formed on said second distal end, said first distal end inserted in said lamp, said first proximal end pressing a first end of said protection plate against said lamp, said lamp and said first end of said protection plate fastened together, said second distal end inserted in said lamp, said second proximal end pressing a second end of said protection plate, said lamp and said second end of said protection plate fastened together, said halogen lamp protection net having a brim and a plurality of meshes, and said halogen lamp protection net and said lamp fastened together.

* * * * *